US005658137A

United States Patent [19]

Mäkelä

[11] Patent Number: 5,658,137

[45] Date of Patent: Aug. 19, 1997

[54] VANE ROTATOR WITH CONICAL BEARING AND BRAKE

[76] Inventor: Jaakko Mäkelä, Linna, Fin-43100 Saarijärvi, Finland

[21] Appl. No.: 592,330

[22] PCT Filed: Jul. 1, 1994

[86] PCT No.: PCT/FI94/00306

§ 371 Date: Jan. 16, 1996

§ 102(e) Date: Jan. 16, 1996

[87] PCT Pub. No.: WO95/02762

PCT Pub. Date: Jan. 26, 1995

[30] Foreign Application Priority Data

Jul. 13, 1993 [FI] Finland ..... 933180

[51] Int. Cl.[6] ..... F03C 2/22; F16C 17/08; F16C 33/10

[52] U.S. Cl. ..... 418/102; 418/181; 418/259; 384/271; 384/399; 477/199

[58] Field of Search ..... 418/102, 181, 418/259; 184/6.18; 477/199; 384/271, 399; 188/381

[56] References Cited

U.S. PATENT DOCUMENTS 2,927,669 3/1960 Walerowski ..... 477/199

3,043,412 7/1962 Bartholomaus et al. ..... 477/199

3,848,716 11/1974 Hanning ..... 477/199

FOREIGN PATENT DOCUMENTS 823499 4/1984 Finland .

843941 4/1986 Finland .

*Primary Examiner*—John J. Vrablik

*Attorney, Agent, or Firm*—Fildes & Outland, P.C.

[57] ABSTRACT

A rotator includes an axle and an associated rotor component having lamellar vanes. A case component surrounds the rotor component. Chambers arranged symmetrically in relation to the axle are disposed between the lamellar vanes. These chambers are pressurized by oil fed through feed and outlet openings connected to the chambers. Bearing members are arranged in an axial direction on both sides of the rotor component. A conical bearing carries the axial rotor load and is formed by a conical arrangement of juxtaposed surfaces defined by the case and axle. The case includes channels leading from the chambers to the conical surfaces for communicating pressurized oil thereamong. The conical arrangement includes spaced gaskets. Oil pressure applied between the conical surfaces raises the axle off the case. In the absence of oil pressure, the conical surfaces lock as a result of friction between the case and axle.

16 Claims, 2 Drawing Sheets

VANE ROTATOR WITH CONICAL BEARING AND BRAKE

FIELD OF THE INVENTION

This invention relates to a hydraulic motor and more particularly to a hydraulic motor operating on the rotating vane principle referred to as a rotator.

BACKGROUND OF THE INVENTION

Known rotators are disclosed in Finnish patent applications 843941 and 823499. It is apparent that the seal between the lamellar vanes and the case in a rotator type machine cannot be effected as well as the seal between a piston and cylinder in a cylinder type machine. In a rotator type machine, a small axial tolerance is provided for the axle to account for heat expansion. This tolerance allows the axle to rotate, even when pressure connections to the rotator are closed. However, it is desirable to lock the axle in place when the rotator is not in use.

In a known rotator, a separate brake device is set around the hydraulic motor. This is a relatively complicated arrangement. In addition, the brake device set around the motor can be easily damaged.

SUMMARY OF THE INVENTION

The present invention provides a rotator with conical bearing and brake which locks the rotator in place when the rotator is not in use.

In carrying out the advantages of the invention, the rotator includes an axle and an associated rotor component having lamellar vanes. A case component surrounds the rotator. Chambers are formed between the case and lamellar wings. These chambers are arranged symmetrically in relation to the axle. Pressurized oil feed and outlet openings are connected to the chambers and bearing members in a generally axial direction on both sides of the rotor component. A conical pressure bearing carries the axial rotor load.

The conical pressure bearing comprises a conical arrangement of juxtaposed surfaces defined by the case and axle. The case includes channels leading from the chambers to the small diameter surface of the conical arrangement. The conical arrangement includes gaskets spaced thereamong the juxtaposed surfaces. The conical arrangement is dimensioned to allow oil pressure acting on the conical surfaces to raise the axle off the case. In the absense of oil pressure, the conical surfaces lock against relative rotation through friction.

The rotator also includes a needle bearing between the axle and the case which carries the excess axial force. A spring member mounted between the axle and the case ensures that the conical surfaces press against one another to create a braking effect in the absence of contrary axial force.

In an alternative embodiment, channels leading from the chambers to the small diameter part of the conical arrangement are equipped with counter-valves to permit a free flow in the direction of the conical arrangement. Throttle members in connection with the counter-valves permit a limited flow away from the conical arrangement, so that the conical surfaces meet one another only after a delay after the pressure has been released.

Preferably half of the conical angle of the conical arrangement is between 10° and 20° and most advantageously between 14° and 16°. The axial tolerance of the conical arrangement preferably is in the range of 0.03–0.23 mm. Preferably the materials in the case and the axle that are opposite one another in the conical arrangement are made from heat-treated steel. The surfaces opposite one another of the conical arrangement may be nitrided.

The construction of the rotor is such that the number of lamellar vanes is at least so great that there is always at least one lamellar vane between the outlet side of the chamber and the channel leading to the conical arrangement.

The invention provides that both bearings and Morse friction locking can operate satisfactorily, even though the metals selected as surface materials and the form of the bearing are not optimal.

These and other features and advantages of the invention will be more fully understood from the following detailed description of the invention taken together with the accompanying drawings.

DETAILED DESCRIPTION OF THE INVENTION

Figure 1:
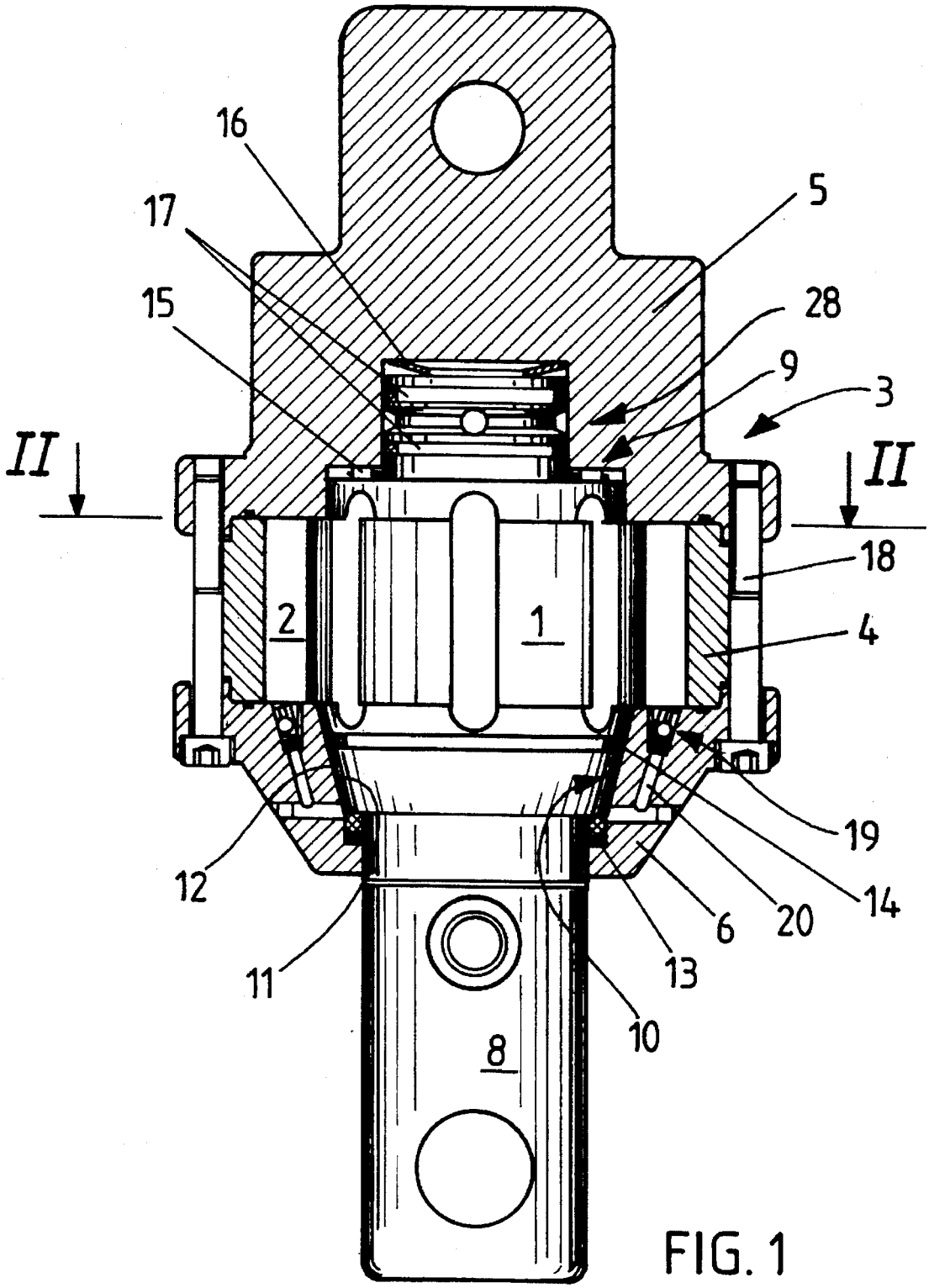
FIG. 1 is a plan view of a rotator including a conical bearing and brake constructed in accordance with the present invention illustrating a case component in section.

Referring now to the drawings in detail, there is shown a hydraulic motor operating on the rotating vane principal and referred to as a rotator. In accordance with the present invention, the rotator is constructed to frictionally lock against rotation in the absence of oil pressure as hereinafter more fully described.

The rotator includes an axle 8 having a rotor 1 on one end thereof. The rotator includes lamellar vanes 2. A case component 3 houses the rotor 1 and mounts bearings which support the axle 8.

Figure 2:
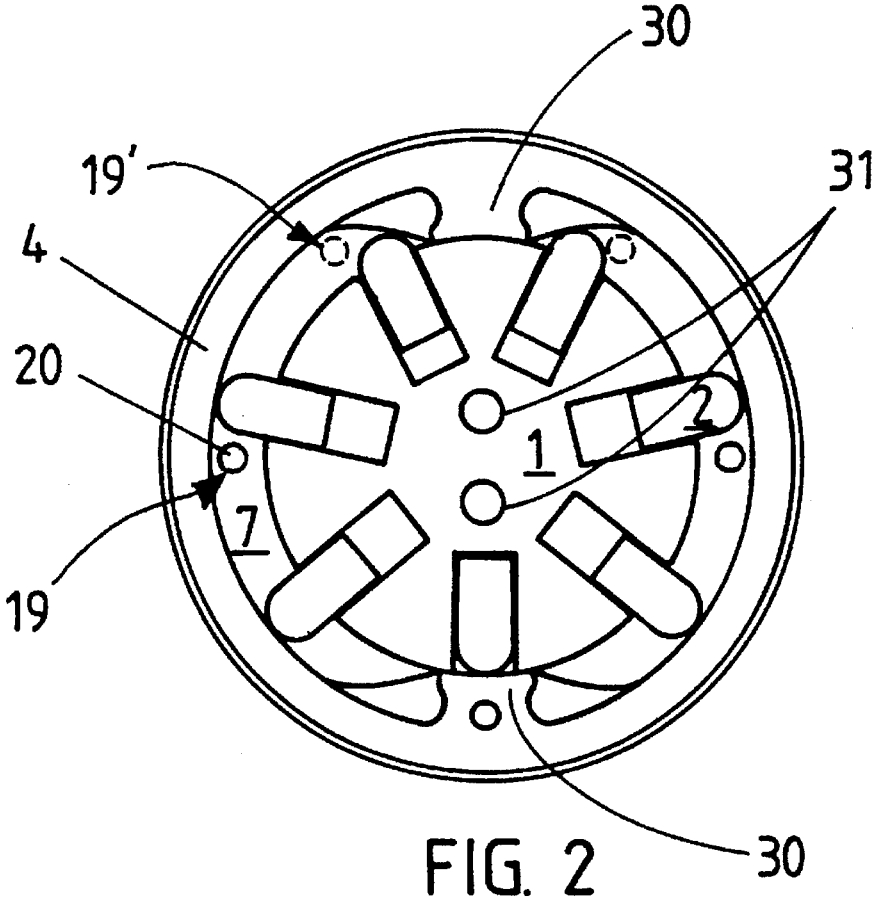
FIG. 2 is a sectional view taken along line 2—2 in FIG. 1.

As illustrated in FIGS. 1 and 2, the rotator includes a cylindrical component 4 that forms part of the case component 3. The cylindrical component 4 surrounds the rotor 1 and includes shut off pieces 30 thereby forming separate chambers 7 around the rotor. Shut off pieces 30 urge lamellar vanes 2 inwardly in a known manner. Chambers 7 are further divided by the lamellar vanes 2.

Chambers 7 include known oil feed and outlet openings, not shown, which are generally located symmetrically, in order to make forward and reverse rotation of the rotator possible.

With continued reference to FIG. 1, case component 3 includes first cover 5, in combination with cylindrical component 4, and a second cover 6. First and second cover 5,6 mount cylindrical component 4 therebetween and are connected by connector bolts 18. The rotator also includes known oil feed and outlet channels, not shown.

FIG. 2 illustrates through-flow channels 31 which are used to communicate oil to the cylinder of a clamp, or grab means for gripping logs which forms no part of this invention.

As illustrated in FIG. 1, bearings 10,15 which support the axle 8 are of a preferred design. Bearing 15 is an axial thrust bearing while bearing 10 is a conical bearing that functions as a brake as is herein described. Bearing 10 is defined by a conically shaped surface 11 of second cover 6. A counter cone 12 juxtaposed the conically shaped surface 11 forms part of the axle 8. Gaskets 13 and 14 are spacedly mounted along the conical Surfaces 11,12. Channels 20 arranged in the second cover 6 extend from the center of chambers 7 to the small diametered portion of the cone 12.

Oil pressure applied to cone 12 through channels 20 when oil pressure is supplied to the rotator, separates cone 12 from the conically shaped surface 11 and unlocks the axle 8 relative to the casing 3. The pressurized oil and arrangement of the conically shaped surface 11 and cone 12 then act as a bearing.

In the illustrated embodiment, the axial movement and tolerance of the conical bearing are only of the order of 0.05 mm but sufficiently dimensioned to change from locking to bearing operation. In practice the tolerance limits are 0.03–0.23 mm and half the conical angle is 15 degrees. Preferably the angle is in the range of 10 to 20 degrees. An angle in the range of 14 to 16 degrees is most advantageous.

Material selection for the juxtaposed surfaces of the conical arrangement is important. In general one surface of a journal bearing is softer than the other. In this application one steel surface is used against another steel surface. Preferably both surfaces are nitrided. The soft base material gives some degree of flexibility. The axial bearing 15 is made as a needle bearing. A radial bearing 35 of journal bearing design is formed in the first cover and supports the axle 8. Herein the materials of the cover and axle are selected with bearing operation in mind. Alternatively, it is possible to utilize a separate bearing sleeve to thereby provide a suitable pair of metals.

Tempering and polishing of the conical surfaces should provide them the greatest durability. However this method is not practicable. With the nitriding process there are only small dimensional changes to the conical surfaces.

With further reference to FIG. 1, a washer or plate spring 16 is used mounted between the first cover 5 and the axle 8, pressing the conical surfaces 11,12 against one another in case there is insufficient axial load.

As illustrated in FIG. 2, the channels are located generally symmetrically and in the center of the chambers 7. During rotation in either direction, at least one lamellar vane is always positioned between channel 19 and the outlet side.

Figure 3:
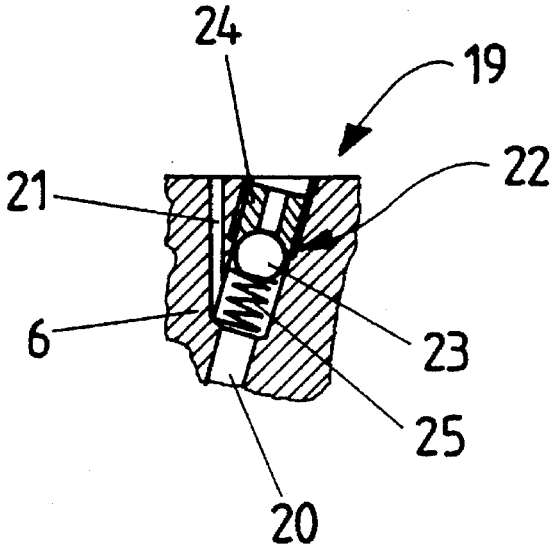
FIG. 3 is an enlarged detail view of an oil channel in the case component.

With reference to FIG. 3, a channel 19 is illustrated with an optional check valve or counter-valve 22 arrangement. Counter-valve 22 consists of a ball 23, a valve piece 24 and a spring 25. These parts are locatable in the outer end of drill hole 20 and, when oil pressure is no longer supplied to the rotator, permit oil pressure to be released gradually from the conical bearing arrangement whereby conical surfaces 11 and 12 are frictionally engaged to lock the rotator against rotation. This may be necessary when changing direction or when there is a short period of no pressure.

It is also possible to construct the hereinabove described conical bearing and brake in the other end of the rotor. By using a separate component as the conical surface, the combined effect of the spring force and pressure is moved either onto the cone or away from it.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

I claim:

1. A rotator, which includes an axially loaded axle and an associated rotor component with lamellar vanes, a case component surrounding the rotor component, chambers having oil feed and outlet openings are arranged symmetrically in relation to the axle around the rotor, bearing members disposed axially on both sides of the rotor component and including a pressure bearing carrying the axially loaded rotor, means biasing the rotor towards the pressure bearing, characterized in that the pressure bearing is composed of a conical arrangement between the case and the axle, and the case includes channels leading from the chambers to the surfaces of the conical arrangement, and the conical arrangement includes spaced gaskets, and that the conical arrangement is angled such that oil pressure from the chambers acting on the conical surfaces raises the axle off the case and without oil pressure the conical arrangement engages to form a friction lock.

2. A rotator in accordance with claim 1, characterized in that above the rotor there is a needle bearing between the axle and the case, which carries axial thrust force.

3. A rotator in accordance with claim 1, characterized in that said biasing means comprises a spring member between the axle and the case provides a minimum axial force urging the conical surfaces against one another to create a braking effect when there is no opposing oil pressure.

4. A rotator in accordance with claim 1, characterized in that the channels leading from the chambers to the conical arrangement are equipped with counter-valves to permit a free flow in the direction of the conical arrangement.

5. A rotator in accordance with claim 4, characterized in that there are throttle members in connection with the counter-valves in order to permit a limited flow away from the conical arrangement, so that the conical surfaces meet one another only after a delay after the oil pressure has been released.

6. A rotator in accordance with claim 5, characterized in that the half of the conical angle of the conical arrangement is between 10° and 20°.

7. A rotator in accordance with claim 6, characterized in that the axial tolerance of the conical arrangement is 0.03–0.23 mm.

8. A rotator in accordance with claim 7, characterized in that the materials in the case and the axle that are opposite one another in the conical arrangement are made from heat-treated steel.

9. A rotator in accordance with claim 8, characterized in that the surfaces opposite one another of the conical arrangement are nitrided.

10. A rotator in accordance with claim 9, characterized in that the number of lamellar vanes is at least so great that there is always at least one lamellar vane between the outlet side of the chamber and the channel leading to the conical arrangement.

11. A rotator in accordance with claim 6 characterized in that the half of the conical angle of the arrangement is between 14° and 16°.

12. A rotator in accordance with claim 1 characterized in that the half of the conical angle of the conical arrangement is between 10° and 20°.

13. A rotator in accordance with claim 1 characterized in that the axial tolerance of the conical arrangement is 0.03–0.23 mm.

14. A rotator in accordance with claim 1 characterized in that the materials in the case and the axle that are opposite one another in the conical arrangement are made from heat-treated steel.

15. A rotator in accordance with claim 14 characterized in that the surfaces opposite one another of the conical arrangement are nitrided.

16. A rotator in accordance with claim 1 characterized in that the number of lamellar vanes is at least so great that there is always at least one lamellar vane between the outlet side of the chamber and the channel leading to the conical arrangement.

* * * * *